United States Patent [19]

Townsend

[11] 4,099,282

[45] Jul. 11, 1978

[54] FLOATABLE POLE MARKER BEACON

[76] Inventor: Richard E. Townsend, 874 San Antonio Pl., San Diego, Calif. 92106

[21] Appl. No.: 795,049

[22] Filed: May 9, 1977

[51] Int. Cl.[2] ..... B63B 21/52

[52] U.S. Cl. ..... 9/8.3 E

[58] Field of Search ..... 9/8 R, 8.3 E, 8.3 R, 9/9; 116/124 B, 173; 200/61.45 M, 161; 335/205; 240/10.6 CH, 10.6 R

[56] References Cited

U.S. PATENT DOCUMENTS

| | | | |
|---|---|---|---|
| 2,300,795 | 11/1942 | McAllister | 9/8.3 E X |
| 2,557,859 | 6/1951 | Bernstein | 116/173 |
| 3,618,150 | 11/1971 | Anselmi | 9/8.3 E |
| 3,641,336 | 2/1972 | Boin | 240/10.6 R |
| 3,953,905 | 5/1976 | Paitson | 9/8.3 E |
| 4,029,954 | 6/1977 | Moyer | 240/10.6 CH |

*Primary Examiner*—Stephen G. Kunin

*Attorney, Agent, or Firm*—R. S. Sciascia; G. J. Rubens

[57] ABSTRACT

A high visibility man-overboard rescue beacon is provided having a strobe light that is automatically energized in a flashing mode by the act of removing the beacon from its holder on board boat. Upon removal from the holder, a set of self-erecting radar reflective coated flags are also automatically deployed.

5 Claims, 5 Drawing Figures

FLOATABLE POLE MARKER BEACON

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to floatable rescue light beacons, and more particularly to such a light beacon which can be stored in any position on a boat and instantly and automatically energized by the act of deploying the beacon overboard from its supporting structure.

Numerous types of distress buoys and beacons have been devised to mark the location of an object floating on the water, such as a man overboard. One of these developments is represented by U.S. Pat. No. 2,300,795, issued on Nov. 3, 1942, which comprises a pole-type marker having a light at the upper end, an intermediate by mounted float, and a battery-operated motor assembly at the bottom end which produces an SOS distress light signal. A liquid mercury switch controls the operation of the light when the beacon is raised from a horizontal, non-operating stowed position for deployment.

SUMMARY OF THE INVENTION

An improved floatable pole-type rescue light beacon is provided that is more compact, less expensive in construction, and more efficient in operation. The beacon comprises a pole support having a strobe light and associated electronics on the upper end, a float collar mounted at an intermediate position, and a battery and magnetically operated switch assembly located at the lower end, the weight of which also provides vertical stability to the beacon in a floating position. A plurality of self-erecting radar reflective flags are also mounted at the upper end which flags are automatically deployed by the removal of a confining protective cover when the beacon is released from its stowed position.

The beacon is detachably supported in any stowed position within a holder having means for attachment to shipboard structure, i.e., a backstay of a sailboat. A magnet is supported within the holder. The switch is magnetically operated and is normally biased to an open position by the holder magnet. Accordingly, there is no limitation as to the orientation of the beacon in the stowed position, i.e., horizontal to vertical, depending on the most convenient structure available.

Separation of the beacon from its holder during deployment will cause the magnetic switch to be automatically and instantaneously closed under spring action to energize the flashing strobe light.

DESCRIPTION OF THE PREFERRED EMBODIMENT

Figure 1:
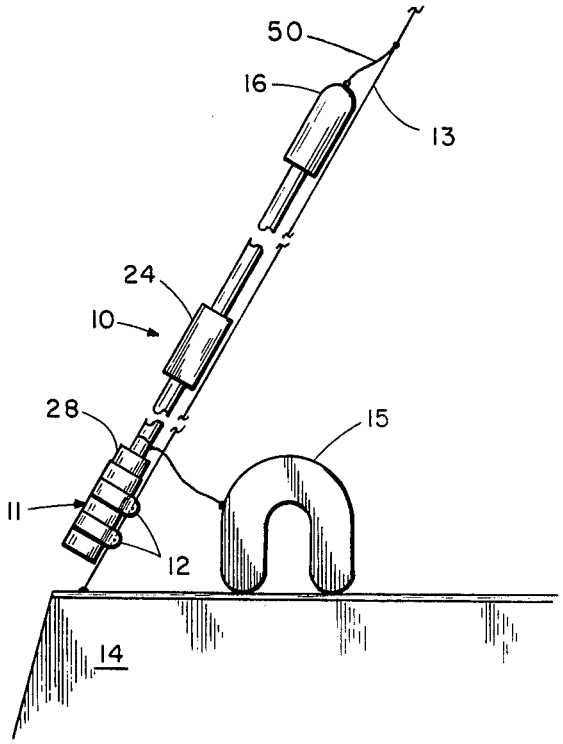
FIG. 1 is a side elevation view of the novel beacon in a stowed condition detachably supported to the backstay of a sailboat.
Figure 2:
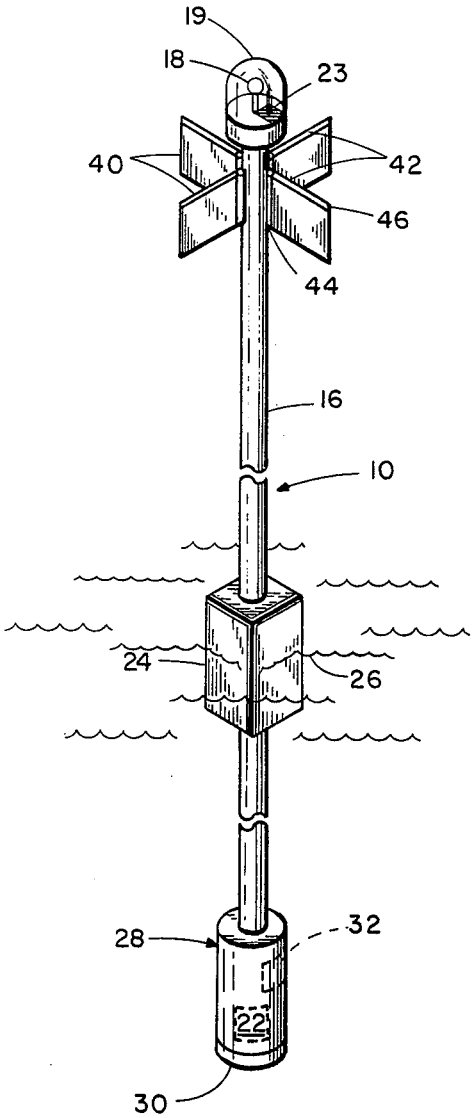
FIG. 2 is an enlarged side elevation view of the beacon in a deployed position.
Figure 3:
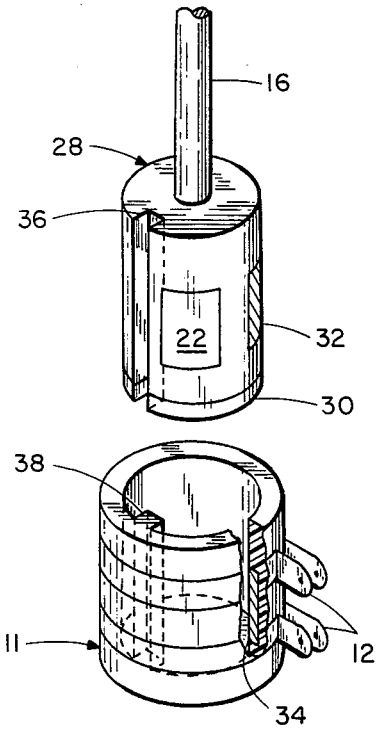
FIG. 3 is an enlarged exploded perspective view of the beacon holder and the battery pack enclosure, partially in section to show the details of the magnetic switch.

Referring to the drawings where like reference numerals refer to similar parts throughout the figures there is shown in FIG. 1 a novel floatable rescue light beacon 10 shown in a typical stowed condition detachably mounted in a holder 11 clamped at 12 to a boat structure, such as a backstay 13 of a sailboat 14. The beacon may be tethered to a life ring 15 for joint deployment. As best shown in FIG. 2, beacon 10 comprises a long, narrow hollow pole 16, preferably made of fiberglass or other suitable light, non-corrosive material. Pole 16 is made preferably 8 to 10 feet in total length, tapered with the larger end at the bottom. Pole 16 can be constructed in one piece, or separable for shipping and telescopically joined for operational use. An electrical connector at the joint enable separation of the two sections for storage or shipping.

Figure 5:
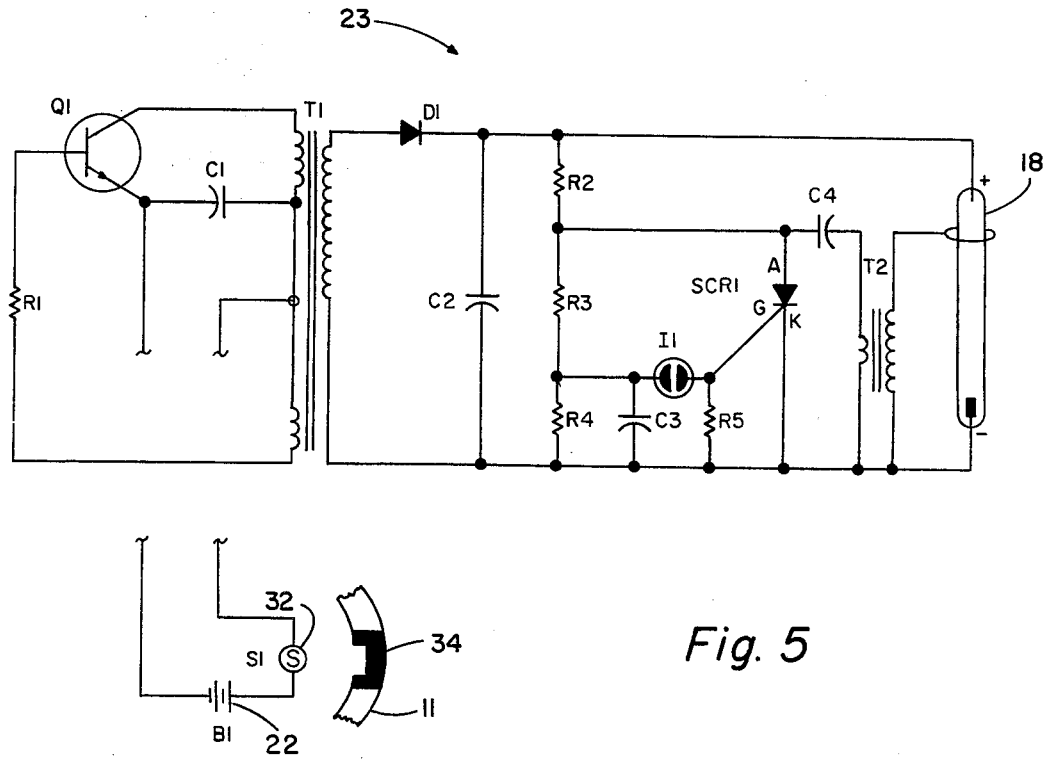
FIG. 5 is a wiring diagram including the strobe light and magnetic switch.

An electronic strobe light 18 or other suitable light source and associated electronic circuitry 23 are housed in a sealed transparent cover 19 mounted on the top of pole 16. Light 18 is energized by electrical conductors 20 that extends down through the pole core to an electrical power source 22 and magnetically actuated switch 32 housed at the bottom end of the pole. Suitable solid state circuitry for the strobe light is illustrated on page 69 of "Popular Electronics" of Oct. 1976, as illustrated in FIG. 5.

A flotation collar 24 is secured around pole 16 at an intermediate position along its length. With a pole having an overall length of 8 to 10 feet, flotation collar 24 is preferably secured at a position where the waterline 26 will be 6 to 8 feet from the top of pole 16, and 2 feet from the bottom of the pole. This position of the light above the water surface greatly increases the probability of rescue in rough seas by improved visibility, especially as it may take several minutes to turn the boat to return to the man-overboard position.

A container 28 is mounted suspended from the bottom of pole 16, access to the container being by a detachable, cap 30 screwed to the lower end of the container and sealed thereto by an O-ring, not shown. Within container 28 is housed the power source 22, which may comprise a battery pack of dry cells. Cap 30 can be weighted, in addition to the weight provided by the battery packs, to provide the pole with sufficient vertical floating stability.

An important feature of the invention is to provide a means for automatically initiating the energization of the beacon light upon deployment that does not limit the orientation of the beacon in the stowed position, and does not require a mechanical connection between the beacon and its holder 11. This objective is accomplished by employing a magnetic reed-type switch 32 which is mounted in the battery container 28 adjacent the outer side surface. A movable contact of magnetic switch 32 is designed to be normally spring-biased to a closed position completing the electronic circuit between light source 18 and power source 22 to energize the light. The movable contact of switch 32 is maintained in an open position by the presence of a suitable magnetic force, which can be in the form of a permanent magnet 34. Magnet 34 may be embedded or otherwise mounted on one side of holder 11. Container keyway 36 and key 38 are provided to ensure the adjacent alignment of switch 32 and magnet 34 when the container and the holder are longitudinally nested together in a stowed condition.

Figure 4:
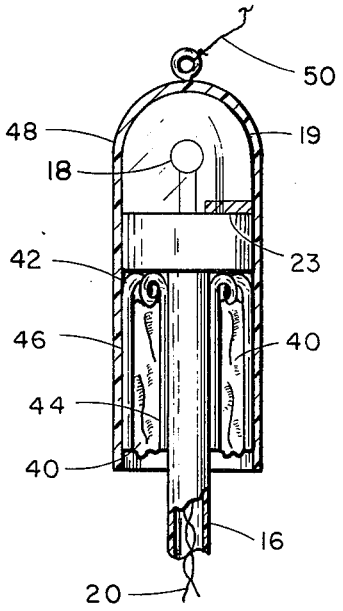
FIG. 4 is an enlarged cross-sectional view of the upper end of the beacon with the flags in a stowed condition.

A plurality of self-erecting spaced flags 40, four being illustrated, are supported to the upper end of pole 16 each by means of normally oriented, right angle stainless steel springs 42. The flags are constructed of flexible material, i.e., "mylar" plastic, having applied a high visibility orange color and radar reflective coating. One leg 44 of each spring is vertically secured along pole 16, the other normally horizontally extending leg 46 of each spring is restrained to a vertical position in a stowed condition (FIG. 4) by a rigid (e.g. plastic) protective sock 48 which also covers and protects the transparent light cover 19. The apex of sock 48 is tethered by line 50 to the stay or other boat structure to provide automatic removal when the beacon is deployed to the water.

FIG. 5 is a typical wiring circuit and represents only one of a variety of strobe light or flashing light circuits, and in no way limits the source of the flashing light to this circuit. Transistor Q1, transformer T1, and associated components form an oscillator which is the basis of the DC-DC converter which is the basis for the high voltage supply necessary to fire the strobe light. When 2–3 volts are applied, the collector current on Q1 accumulates until the ferite core of T1 saturates. At this point the base drive is removed from Q1, the transistor cuts off, and flux in the core of T1 decays. This cycle continues to repeat as long as the 2–3 volts are applied. On the secondary side of T1, high voltage pulses develop which are rectified by D1 and charge C2 to +250 volts. The voltage divider composed of R2, R3, and R4 charges C3 to 90 volts and C4 to 200 volts.

When the potential across C3 reaches approximately 90 volts, neon lamp 11 fires and discharges C3 through the gate of SCR1. This causes SCR1 to turn on, and the charge stored in C4 is discharged into the primary of trigger coil T2. Because of T2's high step-up ratio, a potential difference of several thousand volts is induced across the secondary. This in turn causes the zenon flash tube to fire as the charge stored in C2 flows through the flash tube. When C2's charge is depleted, the tube stops conducting and goes dark. The rectified pulses from D1 start to charge up the capacitors again and the cycle repeats itself.

Operation of the novel beacon is obvious from the structure. After a man-overboard or any other need for deployment of the beacon arises, beacon 10 is lifted out of holder 11 at which time cover 48 is displaced to enable flag 40 to open under the spring tension, and ejected into the water.

As soon as container 28 is removed from holder 11, the magnetic force of magnet 34 loses its influence over magnetic switch 32, and its movable contact is free under spring tension to close the switch and energize light 18.

The novel beacon of this invention is more versatile in that it can be stowed in any position on its supporting structure without affecting its operability. This will enhance accessibility and reduce any time delay which is an important consideration in life supporting equipment. Furthermore, initiation of the light does not require any other act than the one ejecting the beacon over board.

Obviously many modifications and variations of the present invention are possible in the light of the above teachings. It is therefore to be understood that within the scope of the appended claims the invention may be practiced otherwise than as specifically described.

What is claimed is:

1. A floatable pole marker beacon comprising:
a long hollow pole;
a float fixedly secured to said pole at an intermediate position;
an electric light mounted on an upper end of said pole;
a container sealably mounted at the bottom end of said pole;
a source of electrical power housed within said container;
an electricl circuit connecting said power source and the light source;
said circuit including a magnetically operable switch biased to a closed position, said switch being maintained in an open position by the presence of a predetermined magnetic force;
said switch being mounted within the container, and a holder is provided for storing the container, said holder having a magnet aligned with said switch when the beacon is in a stowed condition in the holder;
whereby deployment of the beacon from the holder will automatically close the switch to energize the light source.

2. The beacon of claim 1 wherein at least one self-erecting flag is mounted at the top of said pole, said flag being spring biased with respect to the pole and restrained in a collapsed condition by a slidably removable cover when the container is supported in its holder.

3. A floatable pole marker beacon and detachable holder comprising:
a long hollow pole;
a float fixedly secured to said pole at an intermediate position;
an electric strobe light mounted on the upper end of said pole;
a container sealably mounted at the bottom end of said pole;
a DC power source supported within the container;
a holder for slidably supporting said container, said holder having means for attaching to a supporting structure;
a magnet mounted on said holder;
an electrical circuit connecting the power source to said light;
said circuit including a magnetically operable switch normally biased to a closed position, and magnetically maintained in an open position by the magnet when the container is supported by the holder;
whereby removal of said beacon from the holder for deployment will automatically close the switch to energize the light.

4. A floatable pole marker beacon comprising:
a long hollow pole;
a float fixedly secured to said pole at an intermediate position;
an electric light mounted on an upper end of said pole;
a container sealably mounted at the bottom end of said pole;
a source of electrical power housed within said container;

an electrical circuit connecting said power source and the light source;

said circuit including a magnetically operable switch biased to a closed position, said switch being maintained in an open position by the presence of a predetermined magnetic force;

said switch being mounted within the container, and a holder is provided for storing the container, said holder having a magnet aligned with said switch when the beacon is in a stowed condition in the holder;

said holder telescopically housing said container in the stowed condition, and alignment means are provided between the enclosure and container to ensure the magnet is positioned adjacent said switch;

whereby deployment of the beacon from the holder will automatically close the switch to energize the light source.

5. The beacon of claim 4 wherein said holder is provided with clamping means for securing to a support.

* * * * *